United States Patent [19]

Wedel

[11] Patent Number: 4,934,067

[45] Date of Patent: Jun. 19, 1990

[54] APPARATUS FOR DRYING A WEB

[75] Inventor: Gregory L. Wedel, Beloit, Wis.

[73] Assignee: Beloit Corporation, Beloit, Wis.

[21] Appl. No.: 14,569

[22] Filed: Feb. 13, 1987

[51] Int. Cl.[5] ..... F26B 3/24; F26B 13/08

[52] U.S. Cl. ..... 34/41; 34/116; 34/117; 34/123

[58] Field of Search ..... 34/116, 117, 120, 123

[56] References Cited

U.S. PATENT DOCUMENTS

| | | | |
|---|---|---|---|
| 2,537,129 | 1/1951 | Goodwillie | 92/49 |
| 2,714,342 | 8/1955 | Beachler | 92/53 |
| 2,959,222 | 11/1960 | Hornbostel | 162/360 |
| 3,079,699 | 3/1963 | Fry, Jr. | 34/116 |
| 3,110,612 | 11/1963 | Gottwald et al. | 117/64 |
| 3,263,344 | 8/1966 | Stickle | 34/116 |
| 3,395,073 | 7/1968 | Davis, Sr. | 162/369 |
| 3,868,780 | 3/1975 | Soininen et al. | 34/117 |
| 4,000,035 | 12/1976 | Schiel et al. | 162/290 |
| 4,202,113 | 5/1980 | Kankaanpaa | 34/23 |
| 4,359,827 | 11/1982 | Thomas | 34/16 |
| 4,359,828 | 11/1982 | Thomas | 34/117 |
| 4,441,263 | 4/1984 | Vedenpää | 34/115 |
| 4,481,723 | 11/1984 | Vedenpää | 34/114 |
| 4,483,083 | 11/1984 | Chance | 34/113 |
| 4,510,698 | 4/1985 | Ely | 34/117 |
| 4,539,762 | 9/1985 | Eskelinen et al. | 34/114 |
| 4,566,944 | 1/1986 | Mauranen et al. | 162/286 |
| 4,608,124 | 8/1986 | Mauranen et al. | 162/193 |
| 4,625,430 | 12/1986 | Aula et al. | 34/13 |
| 4,677,762 | 7/1987 | Futcher | 34/114 |
| 4,686,778 | 8/1987 | Kotitschke et al. | 34/117 |

FOREIGN PATENT DOCUMENTS 2173832 11/1986 United Kingdom .

8202937 9/1982 World Int. Prop. O. .

OTHER PUBLICATIONS

G. L. Wedel et al, "Advances in Dryer Section Runnability", *TAPPI Journal*, Sept. 1987, pp. 65–69 International Search Report for PCT/US87/03414, International Filing Date: 18 Dec. 1987.

*Primary Examiner*—Henry A. Bennet

*Attorney, Agent, or Firm*—Dirk J. Veneman; Raymond W. Campbell; David J. Archer

[57] ABSTRACT

An apparatus is disclosed for drying a web of paper emerging from a press section of a papermaking machine. The apparatus includes a first dryer section for transferring the web from the press section to the first dryer section. A second dryer section is disposed downstream relative to the first dryer section for initiating the drying of a second side of the web. A first dryer transfer means transfers the web without open draw between the first and the second dryer sections. The first dryer transfer includes a downstream vacuum roll, a downstream felt roll and a felt extending between the downstream vacuum roll and the downstream felt roll such that the web is conveyed and disposed between the felt and the second dryer section. The second dryer section includes an upstream vacuum roll and an upstream felt roll and a further felt extending between the upstream felt roll and vacuum roll such that the felt and further felt define therebetween a first dryer transfer section for transferring the web without open draw, the first dryer transfer permitting both threading of the web without the assistance of threading ropes and the drying of both sides of the web.

17 Claims, 6 Drawing Sheets

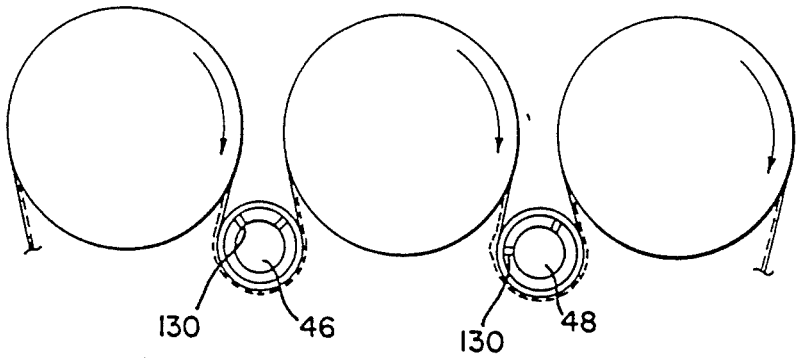
FIG. 8
FIG. 9.
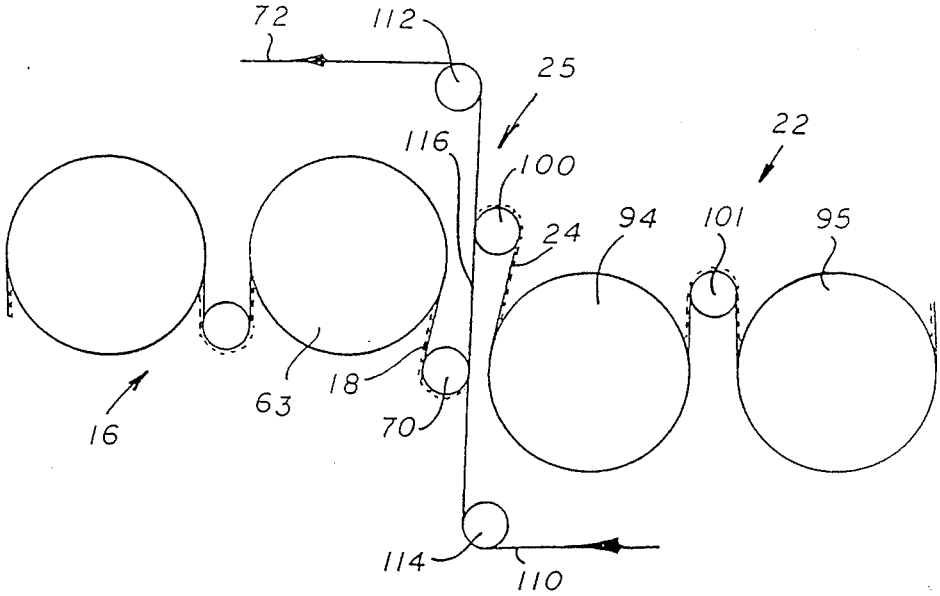

APPARATUS FOR DRYING A WEB

BACKGROUND OF THE INVENTION

1. FIELD OF THE INVENTION

This invention relates to an apparatus for drying a web of paper emerging from a press section of the papermaking machine. More particularly, this invention relates to an apparatus for dyring a web in which the web is transferred without open draw between dryer sections, thereby permitting threading of the web without the assistance of threading ropes and the drying of both sides of the web.

2. INFORMATION DISCLOSURE STATEMENT

With the ever increasing operational speed of papermaking machines a serious problem has existed in that there is a tendency for the paper web or sheet to flutter as the sheet progresses through the dryer section. Such sheet flutter is particularly evident when the sheet is transferred between succeeding sections of the dryer section as the web is transferred between these adjacent sections in an open draw. Such sheet flutter has been minimized by the use of single felting configurations in which the web and felt run jointly between respective top and bottom cylinders. However, the single felt configuration, although reducing the aforementioned probelm of sheet flutter, introduces several disadvantages. Included amongst these disadvantages are, first, the heat transfer from the bottom cylinders is substantially reduced because the wet web is no longer in direct contact with the cylinders, the felt being interposed between the web and the drying surface of the respective cylinder. Second, the web has a tendency to separate from the felt as the web travels twoards and around and then away from the bottom cylinder. Third, the initial threading of the web is not particularly easy.

A partial solution to the aforementioned single felt problems has been provied by the application of the so-called Bel Run dryer section. Bel Run is a registered trademark of Beloit Corporation. With the Bel Run system, the bottom ineffective dryers are replaced by vacuum rolls which positively convey the web from one cylinder to the next. Recent installations of this type of dryer section have shown that the Bel Run concept can be extended to include a large number of dryers without any adverse effect on the web runability. Such runability results because the vacuum rolls are capable of conveying the web along the felt supported spans without the need for sheet tension or section draw points.

With the implementation of the single Bel Run section there exists a tendency to have a generation of stresses which develop in the web as the web dries. Such stresses impart a tendency for the dried paper to curl. Such adverse curling effect can be minimized or eliminated by drying the web from both sides, but two sided drying requires a transfer point in which the web is transferred from one felt to another felt. In the case of the Bel Run configuration, the web must be alternately dried on a top tier dryer section and then on a bottom tier dryer section. A top tier section may be defined as a group of dryers in which the bottom surface of the web contacts the dryers. A bottom tier section conversely and correspondingly may be defined as a group of dryer s in which the top surface of the web contacts the dryers.

In order to efficiently transfer the web from one Bel Run section to another, a positive transfer arrangement is required. In the prior art such means for transferring the web from one drying section to the next has required the introduction of an open draw with the associated problems of sheet flutter and the like.

Modern paper drying machines are contemplated in which web speeds of 10,000 or more feet per minute are invisaged. Consequently, the introduction of such open draws would lead to serious problems of sheet flutter and numerous web breakages. The present invention seeks to overcome the aforementioned inadequacies of the prior art apparatus and to provide a drying apparatus which contributes a significant and unobvious contribution to the paper drying art.

Another object of the present invention is the provision of an apparatus for drying a web of paper emerging from a press section of a papermaking machine such that the web is transferred between a first and a second dryer section means without open draw, thereby permitting both threading of the web without the assistance of threading ropes and the drying of the web on both sides thereof.

Another object of the present invention is the provision of an apparatus for drying a web of paper which completely eliminates the need of open draws.

Another object of the present invention is the provision of an apparatus for drying a web of paper in which open draws for the sheet or web is eliminated.

Another object of the present invention is the provision of an apparatus for drying a web of paper in which blow boxes would be redundant.

Another object of the present invention is the provision of an apparatus for drying a web of paper in which ventilation of the pockets defined by the cylinders and the vacuum rolls in improved, thereby improving the drying rate of the web.

Another object of the present invention is the provision of an apparatus for drying a web of paper in which gear case leaks are inhibited and removal of broke is facilitated.

Another object of the present invention is the provision of an apparatus for drying a web of paper in which fewer steamfits are required and none of the dryers are redundant, thereby reducing the blow through rate.

Another object of the present invention is the provision of an apparatus for drying a web of paper in which the frame is symmetrical and in which the base frame is subjected to equal loading forces, thereby resulting in sturdy low-profile frame which reduces vibration and its attendant noise level.

Another object of the present invention is the provision of an apparatus for drying a web of paper in which the power required to drive the cylinders is reduced and due to the layout and configuration of the dryers, such arrangement lends itself the provision of a low-profile hood.

Another object of the present invention is the provision of an apparatus for drying a web of paper in which runability of the drying apparatus is increased and in which doctors can be applied to each dryer.

Another object of the present invention is the provision of an apparatus for drying a web of paper which permits automatic threading of a tail and subsequent web therethrough.

Another object of the present invention is the provision of an apparatus for drying a web in which open access to the dryers and vacuum rolls in provided and a supply of air can be fed uniformly through each of the vacuum rolls.

Another object of the present invention is the provision of an apparatus for drying a web of paper in which hoods are provided over and adjacent the vacuum rolls for handling the humid exhaust and possibly eliminating the need for large scale exhaust hood construction.

Another object of the present invention is the provision of an apparatus for drying a web of paper in which such vacuum roll hoods can be provided for profiling the web by removing exhaust air from selected transfer sections of these hoods.

Other objects and advantages of the present invention will be apparent to those skilled in the art by a consideration of the following detailed description taken in conjunction with the annexed drawings.

Although the detailed description and annexed drawings describe a preferred embodiment of the present invention, it should be appreciated by those skilled in the art that many variations and modifications of the present invention fall within the spirit and scope of the present invention as defined by the appended claims.

SUMMARY OF THE INVENTION

The present invention relates to an apparatus and method for drying a web of paper emerging from the press section of a papermaking machine. The apparatus includes a first dryer section means for initiating the drying of the first side of the web. The first transfer means transfers the web from the press section to the first dryer section means. A second dryer section means is disposed downstream relative to the first dryer section means for initiating the drying of the second side of the web. The second side of the web is opposite to the first side of the web. A first dryer transfer means transfers the web without open draw between the first and the second dryer section means such that the first dryer transfer means permits both threading of the web without the assistance of threading ropes and the drying of both sides of the web.

More particularly, the first dryer section means also includes a first dryer section for initiating the drying of the first side of the web and a second section disposed downstream relative to the first dryer section for continuing the drying of the first side of the web. A second dryer transfers means transfers the web without open draw between the first and the second dryer sections.

The first dryer section includes a first plurality of dryers and a first plurality of vacuum rolls with each of the vacuum rolls being disposed adjacent to a corresponding dryer of the first plurality of dryers such that the web extends alternately past each vacuum roll and a dryer in serpentine configuration. The first felt extends around the first plurality of dryers and the first plurality of vacuum rolls in close conformity with the web. The second dryer includes a second plurality of dryers and a second plurality of vacuum rolls with each vacuum roll of the second plurality of vacuum rolls being disposed adjacent to a corresponding dryer of the second plurality of dryers, such that the web extends alternately past each vacuum roll and dryer in serpentine configuration. A second felt extends around the second plurality of dryers and vacuum rolls respectively such that the second felt is disposed in close conformity with the web. The second felt and an unfelted portion of a downstream dryer of the first dryers defines a first pick-up section for transferring the web from the unfelt portion onto the second felt so that the web is transferred without draw from the first dryer section to the second dryer section.

Each of the vacuum rolls of the first and the second dryer sections are disposed in spaced close proximity to their adjacent corresponding dryers such that the felt draw between each of the vacuum rolls and the corresponding dryer is minimal, thereby inhibiting any tendency of the web to flutter relative to the supporting felts.

The apparatus also includes a base frame for rotatably supporting the first and the second plurality of dryers such that the axis of the first and the second plurality of dryers are disposed in the first plane. The frame also rotatably supports the first and the second plurality of vacuum rolls such that the axis of the first and second plurality of vacuum rolls disposed in a second plane with the first plane being disposed by the second plane.

An upstream vacuum roll of the second plurality of vacuum rolls is disposed in close proximity of the unfelted portion of the downstream dryer of the first dryer section. A first felt roll is rotatably supported by the base frame for guiding the second felt past and in conformity with the unfelted portion of the downstream dryer and thereafter around the upstream vacuum roll of the second dryer section such that the web is transferred from the unfelted portion to the second felt without open draw.

The first transfer means for transferring the web from the press section to the first dryer section means also includes a lead in roll which is disposed in spaced close proximity relative to the press section. The first felt extends around the lead in roll for transferring the web from the press section to the first dryer section means. A guide roll is disposed between the lead in roll and the first dryer section means for assisting the transfer of the web from the press section towards the first dryer section means. A transfer felt extends around the guide roll such that the transfer felt and the first felt defined therebetween a transfer section for transferring the web from the press section towards the first dryer section means.

The first transfer means also includes an upstream vacuum roll of the first dryer section means. This upstream vacuum roll cooperates with the first felt and the transfer felt such that the transfer section extends from the guide roll to the upstream vacuum roll so that the web emerging from the transfer section is guided around the upstream vacuum roll into the first dryer section means.

The second dryer section means also includes a third plurality of dryers with each of the dryers of this third plurality of dryers being disposed downstream relative to the first dryer section means. A third plurality of vacuum rolls are each disposed in spaced close proximity relative to a corresponding dryer of the third plurality of dryers such that the web extends alternately past each vacuum roll and dryer of the second dryer section means in serpentine configuration.

The third plurality of dryers and vacuum rolls are rotatably secured to the base frame such that the third plurality of dryers are disposed in a third plane and the third plurality of vacuum rolls disposed in a fourth plane with the fourth plane being disposed above the third plane. A third felt extends past the third plurality of dryers and vacuum rolls such that the third felt supports the web through the second dryer section means with the second side of the web being urged by the third felt into close conformity with each dryer of the third plurality of dryers.

The first dryer transfer means also includes a downstream vacuum roll of the first dryer section means. A downstream felt roll of the first dryer section means, a second felt of the first dryer section means extends between the downstream vacuum roll and the downstream felt roll with the second felt supporting the web such that the web is conveyed and disposed between the second felt and the second dryer section means.

The first dryer transfer means also includes an upstream vacuum roll of the second dryer section means and an upstream felt roll. A third felt extends between the upstream felt roll and the upstream vacuum roll of the second dryer section means such that the third felt and the second felt defined therebetween a first dryer transfer means section for transferring the web without open draw from the second to the third felt.

Subsequent dryer section means are provided such that the first, second, third and fourth dryer transfer means permit the transfer of the web between their respective dryer sections without open draw with an alternate reversing of the web such that the first and second side of the web are alternately dried as the web extends through the apparatus and past succeeding dryer section means.

The invention also includes a method of drying a web of paper emerging from a press section of a papermaking machine, the method comprising the steps of transferring the web from the press section to a first dryer section of the apparatus, initiating the drying of a first side of the web during passage of the web through the first dryer and transferring the web without open draw between the first dryer section and a downstream second dryer section, the web transfer being such that the web is reversed so that drying of a second side of the web is initiated during passage of the web through the second dryer section, the second side of the web being opposite to the first side of the web.

The method also includes the step of transferring the web without open draw between subsequent dryer sections such that the first and second side of the web are alternately exposed to the drying effect of the subsequent dryer sections in sequence.

Although the following detailed description exemplifies a particular embodiment of the present invention, it should be understood by those skilled in the art that the present invention is not limited to such an arrangement. Rather the present invention as defined by the appending claims invisages a multitude of variations thereof, including a single felt extending around the dryers of the first and second dryer sections rather than using a first and second felt as shown in the drawings. Furthermore, although the present invention shows the drying apparatus with a first, second, third, fourth and fifth dryer section means the the present invention is not limited to such an arrangement and the various dryer section means may be staggered and disposed in any configuration thereof in order to reduce the overall length of the drying section without the introduction of an open draw.

BRIEF DESCRIPTION OF DRAWINGS

FIG. 8 is a side-elevational view showing the details of two of the vacuum rolls; and FIG. 9 is an enlarged view of a portion of the apparatus shown in FIG. 4 showing the first dryer transfer means.

DETAILED DESCRIPTIONS OF THE PREFERRED EMBODIMENT

Figure 1:
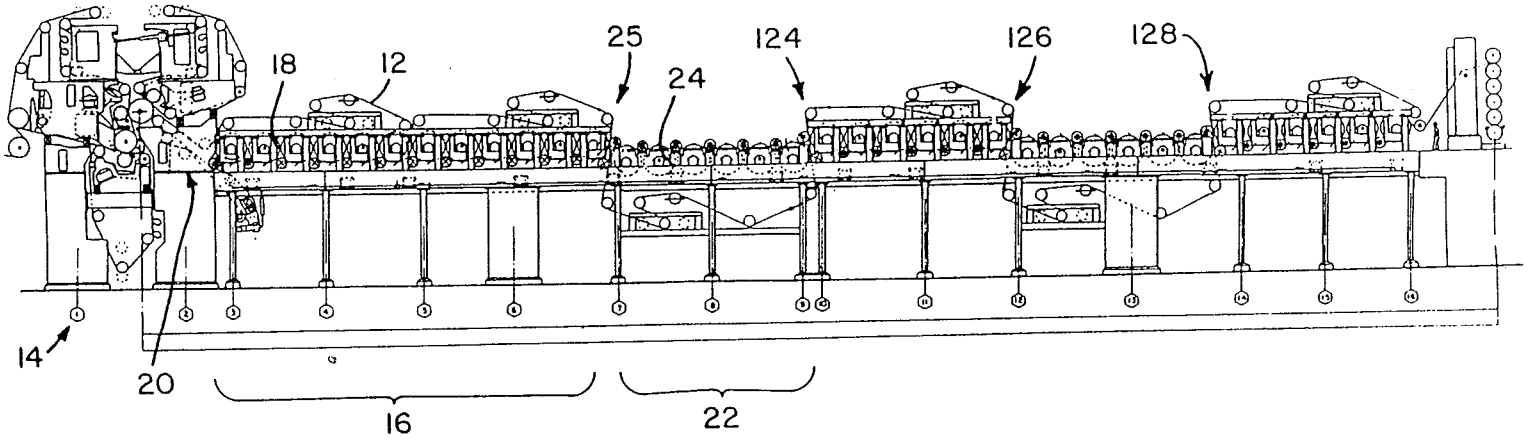
FIG. 1 is a side elevational view of the apparatus according to the present invention showing the press section, the first transfer means, the first dryer section means, the second dryer section means, and the first dryer transfer means, according to the present invention.

FIG. 1 is a side elevational view showing the apparatus generally designated 10 for drying a web 12 of paper emerging from a press section, generally designated 14 of a paper making machine. The apparatus 10 includes a first dryer section means, generally designated 16 for initiating the drying of a first side 18 of the web 12.

A first transfer means generally designated 20 transfers the web 12 from the press section 14 to the first dryer section means 16.

A second dryer section means generally designated 22 is disposed downstream relative to the first dryer section means 16. This second dryer section means 22 initiates the drying of a second side 24 of the web 12. The second side 24 of the web 12 being opposite to the first side 18 thereof.

A first dryer transfer means generally designated 25 transfers the web 12 without open draw between the first and second dryer section means 16 and 22 respectively. The first dryer transfer means 25 permits both threading of the web 12 without the assistance of threading ropes and the drying of both sides 18 and 24 of the web 12.

Figure 2:
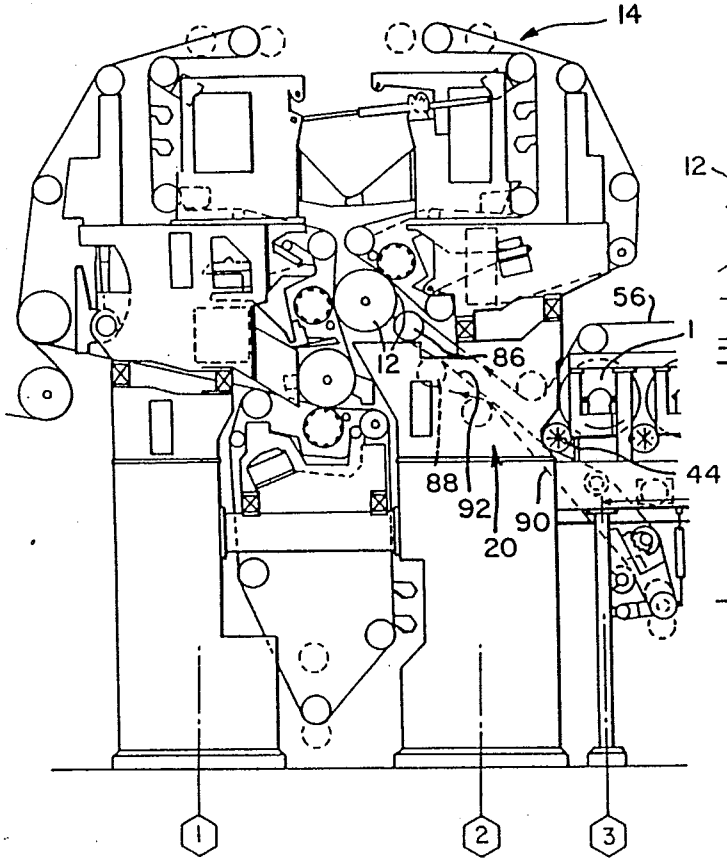
FIG. 2 is an enlarged fragmentary view of FIG. 1 showing the press section, and more particularly, the first transfer means for transferring the web from the press section to the first dryer section.

FIG. 2 shows in more detail the first transfer means 20 and will be described in more detail hereinafter.

Figure 3:
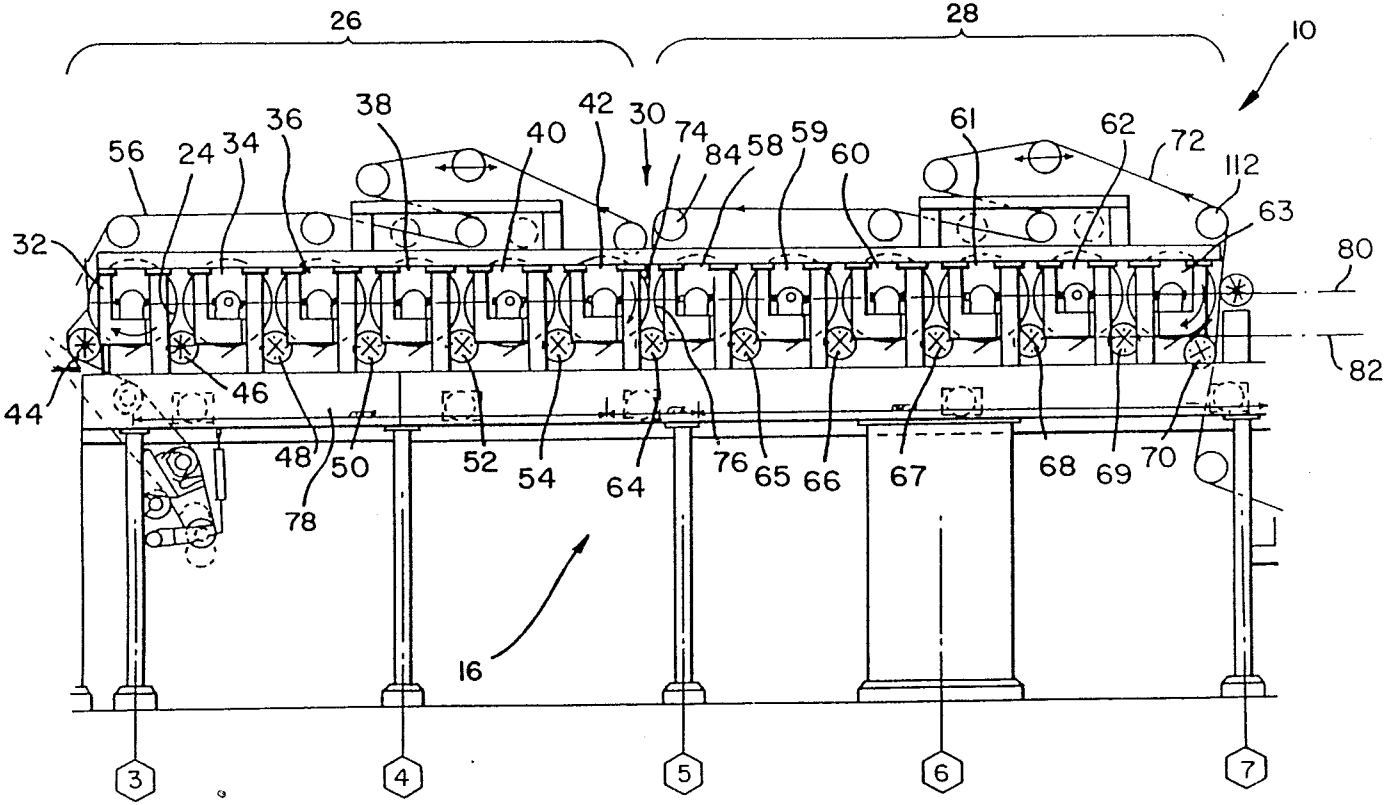
FIG. 3 is an enlarged fragmentary view of FIG. 1 showing the first dryer section means, including the first dryer section and the second dryer section.

FIG. 3 shows in detail the first dryer section means 16. The first dryer section means 16 includes a first dryer section generally designated 26 for initiating the drying of the first side 18 of the web 12. A second driver section generally designated 28 is disposed downstream realtive to the first dryer section 26 for continuing the drying of the first side 18 of the web 12. A further dryer transfer means generally designated 30 transfers the web 12 without open draw between the first and the second dryer sections 26 and 28 respectively.

More particularly, with reference to FIG. 3, the first dryer section also includes a first plurality of dryers 32, 34, 36, 38, 40 and 42 respectively. The first dryer section 26 also includes a first plurality of vacuum rolls 44, 46, 48, 50, 52 and 54 respectively. The first plurality of vacuum rolls 44 to 54 are disposed adjacent to a corresponding dryer of the first plurality of dryers 32 to 42 such that the web 12 extends alternately past each vacuum roll 44 to 54 and dryer 32 to 42 in serpentine configuration.

A first felt 56 extends around the first plurality of dryers 32 to 42 and the first plurality of vacuum rolls 44 to 54 in close conformity with the web 12.

The second dryer section 28 also includes a second plurality of dryers 58, 59, 60, 61, 62 and 63.

The second dryer section 28 also includes a second plurality of vacuum rolls 64, 65, 66, 67, 68, 69 and 70. The vacuum rolls 64 to 70 are disposed adjacent to a corresponding dryer of the second plurality of dryers 58 to 63 such that the web 12 extends alternately past each vacuum roll 64 to 70 and dryer 58 to 63 in serpentine configuration.

A second felt 72 extends around the second plurality of dryers 58 to 63 and the vacuum rolls 64 to 70 respectively such that the second felt 72 is disposed in close conformity with the web 12.

The second felt 72 and an unfelted portion 74 of the downstream dryer 42 of said first dryers 32 to 42 defines a first pick-up section generally designated 76 for transferring the web 12 from the unfelted portion 74 onto the second felt 72 so that the web 12 is transferred without draw from the first dryer section 26 to the second dryer section 28.

Each of the vaccum rolls of the first and the second dryer sections 26 to 28 are disposed in spaced close proximity to their adjacent corresponding dryers such that the felt draw between each of the vacuum rolls and their corresponding dryers is minimal, thereby inhibiting any tendency of the web to flutter relative to the supporting felts 56 and 72 respectively.

As shown in FIG. 3 the apparatus 10 also includes a base frame 78 for rotatably supporting both the first and the second plurality of dryers such that the axis of the first and second plurality of dryers are disposed in a first plane 80 as shown in FIG. 3.

Additionally, the frame 78 rotatably supports the first and second plurality of vacuum rolls such that the axis of the first and the second plurality of vacuum rolls are disposed in a second plane 82 shown in FIG. 3. The first plane 80 is disposed above the second plane 82 as shown in FIG. 3.

As shown in FIG. 3 the apparatus 10 includes an upstream vacuum roll 64 of the second plurality of vacuum rolls and this vacuum roll 64 is disposed in spaced close proximity to the unfelted portion 74 of the downstream dryer 42 of the first dryer section 26.

A first felt roll 84 is rotatably supported by the base frame 78 for guiding the second felt 72 past and in conformity with the unfelted portion 74 of the downstream dryer 42 and thereafter around the upstream vacuum roll 64 of the second dryer section 28 such that the web 12 is transferred from the unfelted portion 74 to the second felt 72 without open draw.

As shown in FIG. 2 referred to hereinbefore the apparatus 10 includes a first transfer means 20 for transferring the web 12 from the press section 14 to the first dryer section means 16. This first transfer means 20 further includes a lead in roll 86 which is disposed in spaced close proximity relative to the press section 14. The first felt 56 extends around this lead in roll 86 for transferring the web 12 from the press section 14 to the first dryer section means 16.

A guide roll 88 is disposed between the lead in roll 86 and the first dryer section means 16 for assisting the transfer of the web 12 from the press section 14 towards the first dryer section means 16.

A transfer felt 90 extends around the guide roll 88 such that the transfer felt 90 and the first felt 56 define therebetween a transfer section 92 for transferring the web 12 from the press section 14 toward the first dryer section means 16.

With futher reference to FIG. 2, the first transfer means 20 further includes an upstream vacuum roll 44 of said first dryer section means 16. The upstream vacuum roll 44 cooperates with the first felt 56 and the transfer felt 90 such that the transfer section 92 extends from the guide roll 88 to the upstream vacuum roll 44 so that the web 12 emerging from the transfer section 92 is guided around the upstream vacuum roll 44 into the first dryer section means 16.

Figure 4:
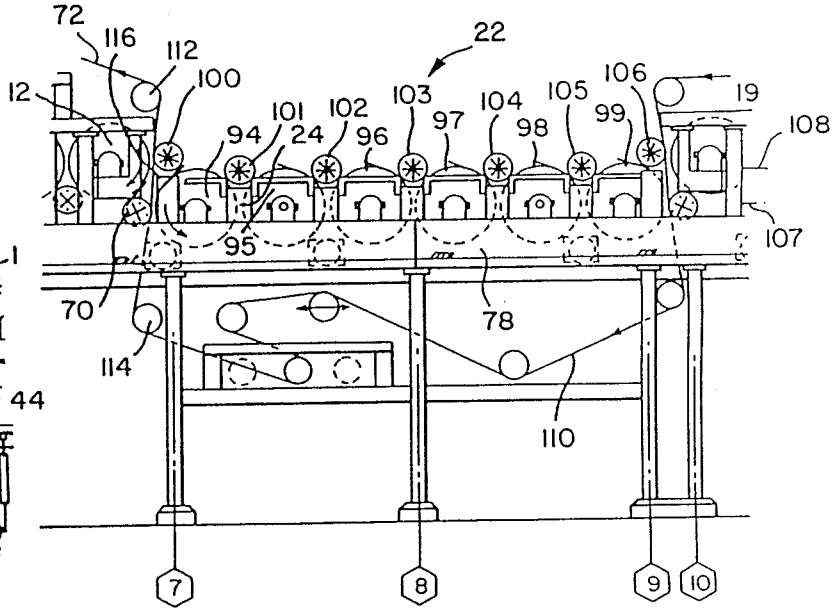
FIG. 4 is an enlarged fragmentary view of FIG. 1 showing the second dryer section means.

With reference to FIG. 4 the second dryer section means 22 also includes a third plurality of dryers 94, 95, 96, 97, 98 and 99. The third plurality of dryers being disposed downstream relative to the first dryer section means 16.

A third plurality of vacuum rolls 100, 101, 102, 103, 104, 105 and 106 are disposed in spaced close proximity relative to a corresponding dryer of the third plurality of dryers such that the web 12 extends alternately past each vacuum roll and dryer to the second dryer section means 22 in serpentine configuration.

As shown in FIG. 4, the baseframe 78 rotatably supports each of the dryers of a third plurality of dryers such that the axes of the dryers are disposed in the third plane 107.

The baseframe also rotatably supports each of the vacuum rolls such that the axes of each of the vacuum rolls of the third plurality of vacuum rolls are disposed in a fourth plane 108 with the fourth plane being disposed above the third plane.

A third felt 110 extends past the third plurality of dryers and vacuum rolls such that the third felt supports the web through the second dryer section means 22 with the second side of the web being urged by the third felt 110 into close conformity with each dryer of the third plurality of dryers.

As shown in FIG. 4, the first dryer transfer means includes a downstream vacuum roll 70 of the first dryer section means 16 and a downstream felt roll 112 of the first dryer section 16.

The second felt 72 of the first dryer section means 16 extends between the downstream vacuum roll 70 and the downstream felt roll 112. The second felt 72 supports the web 12 such that the web is conveyed and disposed between the second felt 72 and the second dryer section means 22.

The first dryer transfer means also includes an upstream vacuum roll 100 of the second dryer section means 22 and an upstream felt roll 114. A third felt 110 extends between the upstream felt roll 114 and the upstream vacuum roll 100 of the second dryer section means 22 such that the third felt 110 and the second felt 72 define therebetween a first dryer transfer means section 116 for transferring the web without open draw from the second to the third felts 72 and 110 respectively.

The third felt 110 presses against the web such that the second side of the web is pressed into close conformity with each dryer of the third plurality of dryers such that the second side of the web is dried.

Figure 6:
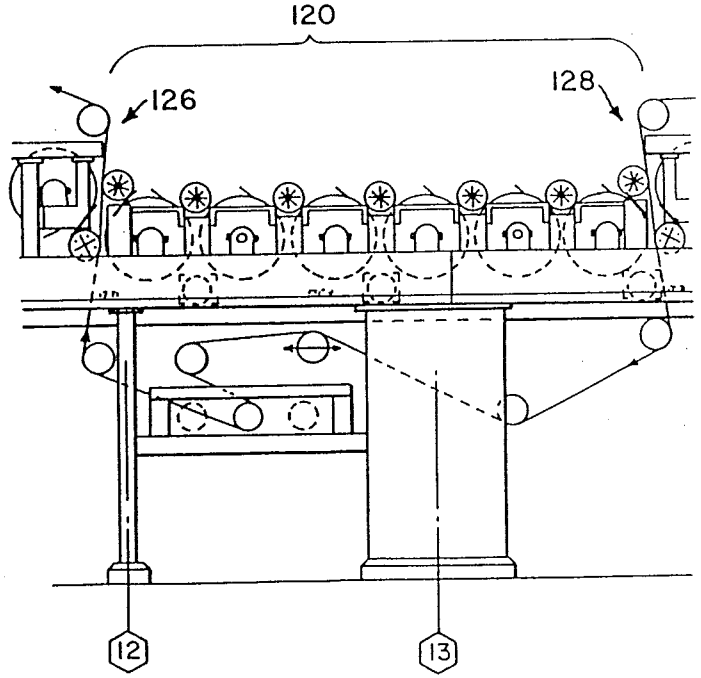
FIG. 6. is an enlarged fragmentary view of FIG. 1 showing the fourth dryer section means.
Figure 5:
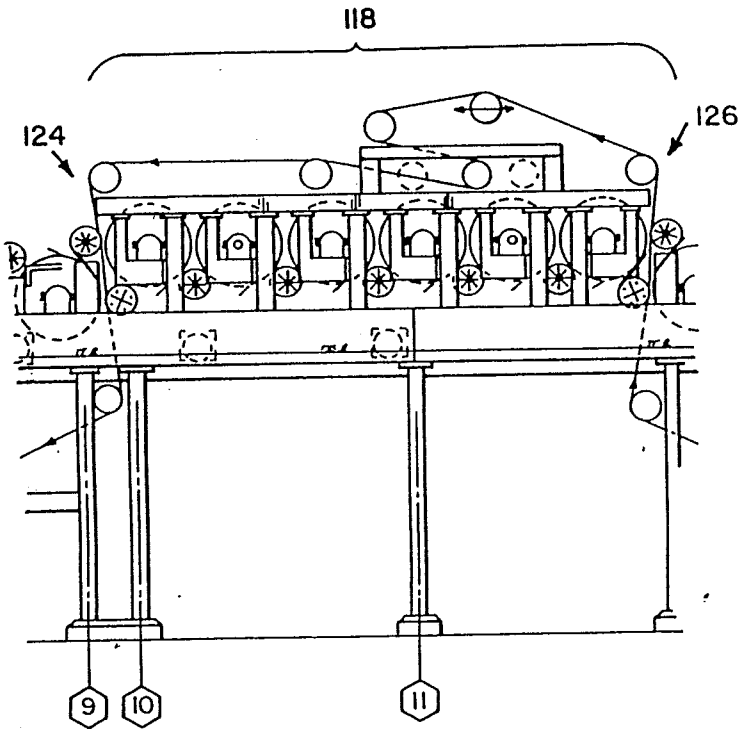
FIG. 5 is an enlarged fragmentary view of the third dryer section means.
Figure 7:
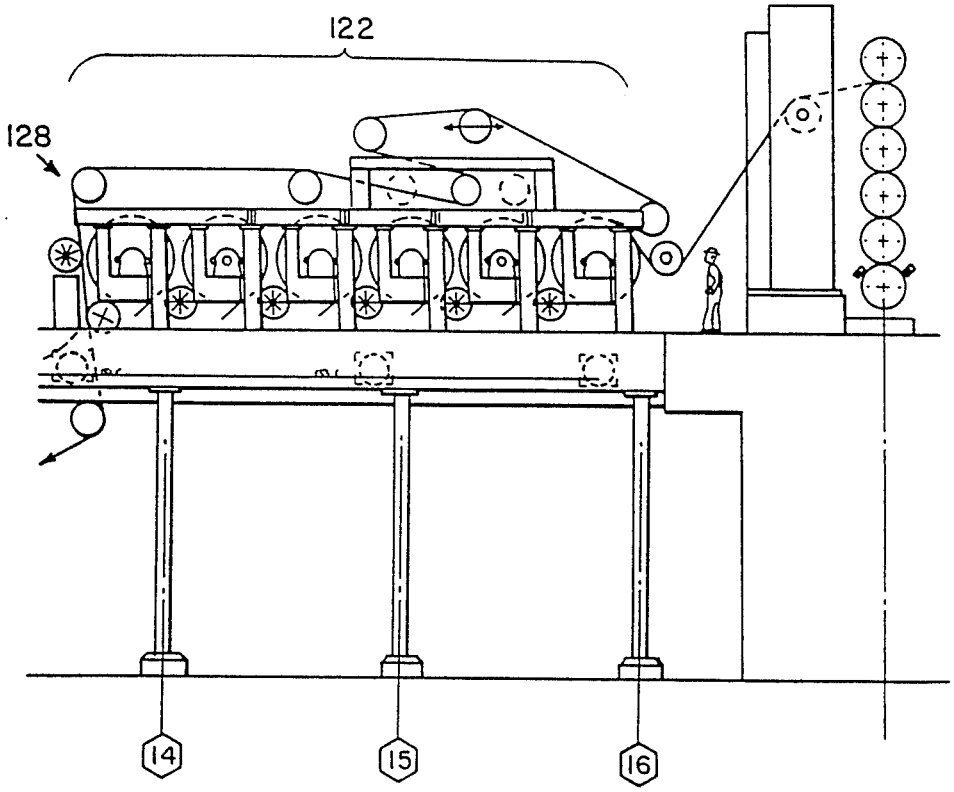
FIG. 7 is an enlarged fragmentary view of FIG. 1 showing the fifth dryer section means.

FIGS. 5,6 and 7 respectively show third, fourth and fifth dryer section means respectively and second, third and fourth dryer transfer means 118, 120 and 122 respectively for transferring and reversing the web as the web progresses through the drying apparatus. The first, second, third and fourth dryer transfer means 25, 124,

126 and 128 permit the transfer of the web between the respective dryer sections 16, 22, 118, 120 and 122 without open draw and with an alternate reversing of the web such that the first and second sides of the web are alternately dried as the web extends through the apparatus and past succeeding dryer section means.

FIG. 8 shows the details of two of the vacuum rolls 46,48 in which pressure seals 130 may be moved from the position shown with reference to the roll 46 to that shown relative to roll 48 for counteracting the tendency of the web to part from the felt.

FIG. 9 is an enlargement of a portion of the apparatus shown in FIG. 4 and shows the first dryer transfer means 25. More particularly, the web shown in dotted outline is sandwiched between the felt 72 and the dryer 63 for drying the first side 18 of the web. Thereafter, the web and felt 72 extend around the downstream vacuum roll 70. The felt 72 then extends around the downstream felt roll 112. The further felt 110 extends around the upstream felt roll 114 and thereafter around the upstream vacuum roll 100 of the second dryer section means 22 so that the felt 72 and the further felt 110 define therebetween the first dryer transfer means section 116.

In operation of the apparatus, the web is transferred from the press section to a first dryer section of the apparatus. Drying of the first side of the web is initiated during passage of the web through the first drying section 16. The web is transferred without open draw between the first dryer section 16 and a downstream second dryer section 22 with the web transfer being such that the web is reversed so that drying of the second side of the web is initiated during passage of the web through the second dryer section 22.

In operation of the apparatus, the web is also transferred without open draw between subsequent dryer sections such that the first and second sides of the web are alternately exposed to the drying effect of the subsequent dryer sections in sequence.

The present invention provides a drying section which is capable of operating at extremely high speeds as no open draws exist between the various sections thereof. Furthermore, the present invention enables threading of the drying section without the use of threading ropes.

What is claimed is:

1. Apparatus for drying a web of paper emerging from a press section of a papermaking machine, said apparatus comprising:

first dryer section means for initiating the drying of a first side of the web;

first transfer means for transferring the web from the press section to said first dryer section means;

second dryer section means disposed downstream relative to said first dryer section means for initiating the drying of a second side of the web, said second side of the web being opposite to said first side thereof;

first dryer transfer means for transferring the web without open draw between said first and second dryer section means, said first dryer transfer means permitting the drying of both sides of the web;

said first dryer transfer means further including:

a downstream vacuum roll of said first dryer section means;

a downstream felt roll of said first dryer section means;

felt means of said first dryer section means extending between said downstream vacuum roll and said downstream felt roll, said felt means supporting the web such that the web is conveyed and disposed between said felt means and said second dryer section means;

an upstream vacuum roll of said second dryer section means;

an upstream felt roll of said second dryer section means;

a further felt extending between said upstream felt roll and said upstream vacuum roll of said second dryer section means such that said further felt and said felt means define therebetween a first dryer transfer means section for transferring the web without open draw from said felt means to said further felt;

said first dryer transfer means section extending from said downstream vacuum roll of said first dryer section means to said upstream vacuum roll of said second dryer section means for transferring the web to said further felt; and said felt means and said further felt being free from restraining means from said downstream vacuum roll to said upstream vacuum roll.

2. An apparatus as set forth in claim 1 wherein said first dryer section means further includes:

a first dryer section for initiating the drying of said first side of the web;

a second dryer section disposed downstream relative to said first dryer section for continuing the drying of said first side of the web;

further dryer transfer means for transferring the web without open draw between said first and said second dryer sections.

3. An apparatus as set forth in claim 2 wherein said first dryer section further includes:

a first plurality of dryers;

a first plurality of vacuum rolls, each vacuum roll of said first plurality of vacuum rolls being disposed adjacent to a corresponding dryer of said first plurality of dryers such that the web extends alternately past each vacuum roll and dryer in serpentine configuration;

a first felt extending around said first plurality of dryers and said first plurality of vacuum rolls in close conformity with the web;

said second dryer section further including:

a second plurality of dryers;

a second plurality of vacuum rolls, each vacuum roll of said second plurality of vacuum rolls being disposed adjacent to a corresponding dryer of said second plurality of dryers such that the web extends alternately past each vacuum roll and dryer in serpentine configuration;

a second felt extending around said second plurality of said dryers and vacuum rolls respectively such that said second felt is disposed in close conformity with the web;

said second felt and an unfelted portion of a downstream dryer of said first dryers defining a first pickup section for transferring the web from said unfelted portion onto said second felt so that the web is transferred without draw from said first dryer section to said second dryer section;

said felt means including:

said first and said second felts.

4. An apparatus as set forth in claim 3 wherein each of said vacuum rolls of said first and second dryer sections are disposed in spaced close proximity to said adjacent corresponding dryer such that the felt draw between each of said vacuum rolls and said corresponding dryer is minimal, thereby inhibiting any tendency of the web to flutter relative to said supporting felts.

5. An apparatus as set forth in claim 4 further including:

a base frame for rotatably supporting said first and said second plurality of dryers such that the axis of said first and second plurality of dryers are disposed in a first plane;

said frame rotatably supporting said first and said second plurality of vacuum rolls such that the axis of said first and second plurality of vacuum rolls are disposed in a second plane.

6. An apparatus as set forth in claim 5 wherein said first plane is disposed above said second plane.

7. An apparatus as set forth in claim 6 wherein an upstream vacuum roll of said second plurality of vacuum rolls is disposed in spaced close proximity to said unfelted portion of said downstream dryer of said first dryer section;

a first felt roll rotatably supported by said base frame for guiding said second felt past and in conformity with said unfelted portion of said downstream dryer and thereafter around said upstream vacuum roll of said second dryer section such that the web is transferred from said unfelted portion to said second felt without open draw.

8. An apparatus as set forth in claim 1 wherein said first transfer means for transferring the web from the press section to the first dryer section means further includes:

a lead-in roll disposed in close proximity relative to the press section;

a first felt extending around said lead-in roll for transferring the web from the press section to said first dryer section means;

a guide roll disposed between said lead-in roll and said first dryer section means for assisting the transfer of the web from the press section toward said first dryer section means;

a transfer felt extending around said guide roll such that said transfer felt and said first felt define therebetween a transfer section for transferring the web from the press section towards said first dryer section means;

said felt means including:

said transfer felt and said first felt.

9. An apparatus as set forth in claim 8 wherein said first transfer means further includes an upstream vacuum roll of said first dryer section means, said upstream vacuum roll cooperating with said first felt and said transfer felt such that said transfer section extends from said guide roll to said upstream vacuum roll so that the web emerging from said transfer section is guided around said upstream vacuum roll into said first dryer section means.

10. An apparatus as set forth in claim 1 wherein said second dryer section means further includes:

a plurality of dryers, each of said dryers of said plurality of dryers being disposed downstream relative to said first dryer section means;

a plurality of vacuum rolls, each vacuum roll of said plurality of vacuum rolls being disposed in spaced, close proximity relative to a corresponding dryer of said plurality of dryers such that the web extends alternately past each vacuum roll and dryer of said second dryer section means in serpentine configuration.

11. An apparatus as set forth in claim 10 further including:

a baseframe;

said baseframe rotatably supporting each dryer of said plurality of dryers such that the axes of said dryers of said plurality of dryers are disposed in a plane;

said baseframe rotatably supporting each vacuum roll of said plurality of vacuum rolls such that the axes of each of said vacuum rolls of said plurality of vacuum rolls are disposed in a further plane.

12. An apparatus as set forth in claim 11 wherein;

said further plane is disposed above said plane;

said further felt extending past said plurality of dryers and vacuum rolls such that said further felt supports the web through said second dryer section means with the second side of the web being urged by said further felt into close conformity with each dryer of said plurality of dryers.

13. An apparatus as set forth in claim 1 wherein said second dryer section means further includes:

a plurality of dryers;

said further felt pressing said second side of the web into close conformity with each dryer of said plurality of dryers such that said second side of the web is dried.

14. Apparatus as set forth in claim 1 further including:

a third dryer section means disposed downstream relative to said second dryer section means;

second dryer transfer means for transferring the web without open draw between the second dryer section means and said third dryer section means;

fourth dryer section means disposed downstream relative to said third dryer section means;

third dryer transfer means for transferring the web without open draw between said third and said fourth dryer section means;

fifth dryer section means disposed downstream relative to said fourth dryer section means;

fourth dryer transfer means dipsosed between said fourth and said fifth dryer section means for transferring the web without open draw between said fourth and fifth dryer section means;

said first, second, third, and fourth dryer transfer means permitting the transfer of the web between said respective dryer sections without open draw and with an alternate reversing of the web such that said first and second sides of the web are alternately dried as the web extends through the apparatus and past succeeding dryer section means.

15. A method of drying a web of paper merging from a press section of a papermaking machine, the method comprising the steps of:

transferring the web from the press section to a first dryer section means of the apparatus;

initiating the drying of a first side of the web during passage of the web through the first dryer section means;

transferring the web without open draw between the first dryer section means and a downstream second dryer section means, the web transfer being such that the web is reversed so that drying of a second side of the web is initiated during passage of the web through the second dryer section means, the second side of the web being opposite to the first side of the web;

the step of transferring the web without open draw further including:

guiding the web around a downstream vacuum roll of the first dryer section means;

leading a felt around a downstream felt roll of the first dryer section means;

guiding the felt of the first dryer section means such that the felt extends between the downstream vacuum roll and the downstream felt roll with the felt supporting the web such that the web is conveyed and disposed between the felt and the second dryer section means; and guiding a further felt between an upstream felt roll of the second dryer section means and an upstream vacuum roll of the second dryer section means such that the further felt and the felt define therebetween a first dryer transfer means section for transferring the web without open draw from the felt to the further felt, the first dryer transfer means section extending from the downstream vacuum roll of the first dryer section means to the upstream vacuum roll of the second dryer section means for transferring the web to the further felt, at least one of said felts being free of restraining means from the downstream vacuum roll to the upstream vacuum roll.

16. A method as set forth in claim 15 further including the steps of transferring the web without open draw between subsequent dryer section means such that the first and second sides of the web are alternately exposed to the drying effect of the subsequent dryer section means in sequence.

17. A single tier drying section for drying a web comprising in combination:

a dryer;

a felt guided about said dryer such that the web is disposed between said dryer and said felt for drying a first side of the web;

a further dryer disposed downstream relative to said dryer;

a further felt guided about said further dryer such that the web is disposed between said further dryer and said further felt for drying a second side of the web;

dryer transfer means for transferring the web from said dryer to said further dryer;

said dryer transfer means transferring the web without open draw from said dryer to said further dryer;

said dryer transfer means further including:

a joint run of said felt and said further felt such that the web is disposed between said felt and said further felt during passage through said joint run; and vacuum roll means disposed downstream relative to said joint run for positively maintaining the web in close conformity with said further felt when said felt and further felt diverge realtive to each other downstream relative to said joint run, said felt and said further felt being free from restraining means during passage of said felt and said further felt through said joint run.

* * * * *

UNITED STATES PATENT AND TRADEMARK OFFICE

CERTIFICATE OF CORRECTION

PATENT NO. : 4,934,067

DATED : June 19, 1990

INVENTOR(S) : Gregory L. Wedel

It is certified that error appears in the above-identified patent and that said Letters Patent is hereby corrected as shown below:

On the title page, item [19, should read --Wedel et al; and item [75], should read --Inventors: Gregory L. Wedel; Borgeir Skaugen, both of Beloit, Wis.--.

| | |
|---|---|
| Column 1, lines 28-29: | Please delete "probelm" and insert therefor --problem-- |
| Column 1, line 36: | Please delete "twoards" and insert therefor --towards-- |
| Column 1, line 67: | Please delete "dryer s" and insert therefor --dryers-- |
| Column 2, line 36: | Please delete "in" and insert therefor --is-- |
| Column 3, line 46: | Please delete "transfers" and insert therefor --transfer-- |
| Column 5, line 55: | Please delete "means the" and insert therefor --means,-- |
| Column 6, line 52: | Please delete "driver" and insert therefor --dryer-- |
| Column 7, line 24: | Please delete "vaccum" and insert therefor --vacuum-- |

Signed and Sealed this

Sixth Day of October, 1992

*Attest:*

DOUGLAS B. COMER

*Attesting Officer*

*Acting Commissioner of Patents and Trademarks*